United States Patent [19]

Baird, Sr. et al.

[11] Patent Number: 4,573,235

[45] Date of Patent: Mar. 4, 1986

[54] RUG CLEANING ATTACHMENT

[75] Inventors: Thomas E. Baird, Sr., Springfield, Ill.; John J. Jailor, N. Ridgeville, Ohio

[73] Assignee: The Scott & Fetzer Company, Cleveland, Ohio

[21] Appl. No.: 665,438

[22] Filed: Oct. 26, 1984

[51] Int. Cl.[4] ..... A47L 11/34

[52] U.S. Cl. ..... 15/328; 15/50 C; 15/320; 15/339

[58] Field of Search ..... 15/320, 328, 50 C, 339

[56] References Cited

U.S. PATENT DOCUMENTS

| | | | |
|---|---|---|---|
| 1,268,963 | 6/1918 | Gray | 15/50 C X |
| 2,293,722 | 8/1942 | Erickson | 15/50 C X |
| 2,333,829 | 11/1943 | Terry | 15/50 C X |
| 3,370,315 | 2/1968 | MacFarland et al. | 15/349 X |
| 3,676,889 | 7/1972 | Edlin | 15/320 |
| 3,875,605 | 4/1975 | Fegan | 15/50 C |
| 4,176,421 | 12/1979 | Baird | 15/50 C X |
| 4,507,819 | 4/1985 | Martinec | 15/50 C X |

*Primary Examiner*—Chris K. Moore

*Attorney, Agent, or Firm*—Pearne, Gordon, Sessions, McCoy, Granger & Tilberry

[57] ABSTRACT

A rug cleaning attachment for a vacuum cleaner is disclosed. The attachment has a suds confining chamber and a scrubbing brush roll mounted thereon for rotation about a horizontal axis within the chamber. The brush roll has a multiplicity of tufts which are adapted to scrub suds into the rug and which define a cylindrical envelope upon rotation of the brush roll. A shield closely conforms to the cylindrical element and guards against suds being centrifugally thrown into the drive and/or suction components of the vacuum cleaner. A scalloped doctor blade is provided for the brush roll which projects into the cylindrical envelope defined by the tufts to scrape spent suds and lint from the brush roll.

6 Claims, 8 Drawing Figures

RUG CLEANING ATTACHMENT

BACKGROUND OF THE INVENTION

This invention relates to rug cleaning attachments for vacuum cleaners. More particularly, this invention relates to a rug cleaning attachment which has a suds confining chamber and a scrubbing brush mounted thereon for rotation about a horizontal axis within the chamber. In one specific aspect, the invention relates to a rug cleaning attachment for use with a vacuum cleaner of the type having a fan casing with a vacuum housing for attaching a vacuum nozzle and a fan shaft that projects through an opening and having a belt receiving portion outside of the fan casing which may normally receive the driving belt of the rotary brush in the vacuum nozzle.

It has long been recognized that effective suction or vacuum cleaning of a rug may be accomplished by a vacuum nozzle having a brush mounted on a horizontal axis so that the brush picks the dirt out of the carpet pile and this dirt is removed by the suction of the cleaner. Cleaning devices which are intended to shampoo or wet clean a rug, however, are customarily provided with one or more brushes that are mounted for rotation about vertical axes. A suitable rug cleaning solution is foamed into the rug in the vicinity of the brushes and is worked into the rug by the brushes. The bristles of those brushes scrub the rug in an orbital manner and, consequently, the dirt is driven downwardly into the pile of the rug and the orbital brush movement causes the carpet pile to form tangled nubs. Thus, the rug appears to be clean, since the dirt has been removed from the upper ends of the filaments of the rug, but, in fact, the dirt has been driven downwardly into the pile. It is very difficult to remove this dirt by later vacuuming because the rug detergent tends to harden and hold the dirt in the pile as a cake. Rug cleaning brushes which are mounted for rotation about vertical axes, moreover, tend to twist the filaments of the rug and also tend to concentrate the nap into small tufts or balls.

Attempts have been made to overcome the deficiencies of the previously described rug cleaners by mounting the cleaning brush for rotation about a horizontal axis. These attempts were not all together successful, since the cleaning suds were not initially confined to the zone of contact between the brush and the rug, and effective means were not provided for the removal of the spent or soiled suds. Thus, while a driven horizontal brush provided a deep cleaning action it inherently created a problem of suds confinement at its working surface and suds disposal and containment since the horizontal brush tends to throw the suds tangentially upwardly while a brush mounted on a vertical axis would tend to throw the suds laterally along the carpet in a less objectionable fashion.

In U.S. Pat. No. 3,370,315 there is disclosed a rug cleaning attachment which successfully overcame many of these prior art problems by providing an attachment which has a suds confining chamber and a brush mounted for rotation about its horizontal axis which could be readily and conveniently operatively engaged and disengaged from the vacuum cleaner without special tools or skills. The rug cleaning attachment according to that patent collects any nap which is removed from the carpeting and which discharges soiled and spent rug cleaning suds into a conveniently accessible chamber. Further according to that prior art patent the spent suds were scraped from the horizontal brush by a doctor blade having a straight blade which engages the rotating suds laden bristles.

While the commercial devices produced according to the aforementioned patent perform their intended purpose and effectively remove soil from rugs, certain operational drawbacks are experienced. As the horizontal brush rotates from its rug scrubbing position to the suds scraping doctor blade, the spent suds on the brush are subjected to centrifugal forces which tend to spray the spent suds in the nozzle chamber. Although the nozzle chamber is vented to minimize direct suction from the carpet to the fan housing, spent suds are inevitably drawn into the fan and motor housing of the vacuum cleaner. Moreover those suds are sprayed onto the driving belt and its drive shaft. Furthermore, the suds which are generated ahead of the brush are laid in a path along the entire extent of the horizontal brush and those suds tend to act as a lubricant between the drive belt and the horizontal brush causing further belt slippage. Also, generated and spent suds tend to foul the end bearings for the horizontal brush.

The doctor blade of the commercial device presents a further operational problem after continued use. After such use the bristle ends of the brush tend to be worn by the straight edged doctor blade and the suds stripping action of the blade is gradually diminished necessitating incremental adjustments of the blade toward the axis of the brush.

SUMMARY OF THE INVENTION

This invention provides a rug cleaning attachment for a vacuum cleaner which possesses all of the operational advantages of the attachment shown and described in U.S. Pat. No. 3,370,315 and which has improved operational characteristics. Specifically, the rug cleaner attachment according to this invention is provided with a protective housing or sheath which envelopes and closely conform to the arcuate travel of the brush bristles between their rug scrubbing positions and their doctor blade engaging positions. The sheath is pivoted to the brush housing so that it may be swung clear of the brush for cleaning.

A doctor blade having a scalloped edge is provided which accommodates for brush wear and provides an extremely effective doctoring edge for the spent suds and linty strands. The scalloped edge of the blade tends to force the bristles together as the bristles are drawn along the intrados of each arch forming a scallop toward the point of maximum rise thereof to squeeze spent suds from the brush, much like the action resulting when one squeezes or combs excess paint from a paint brush.

DETAILED DESCRIPTION OF THE PREFERRED EMBODIMENT

Figure 1:
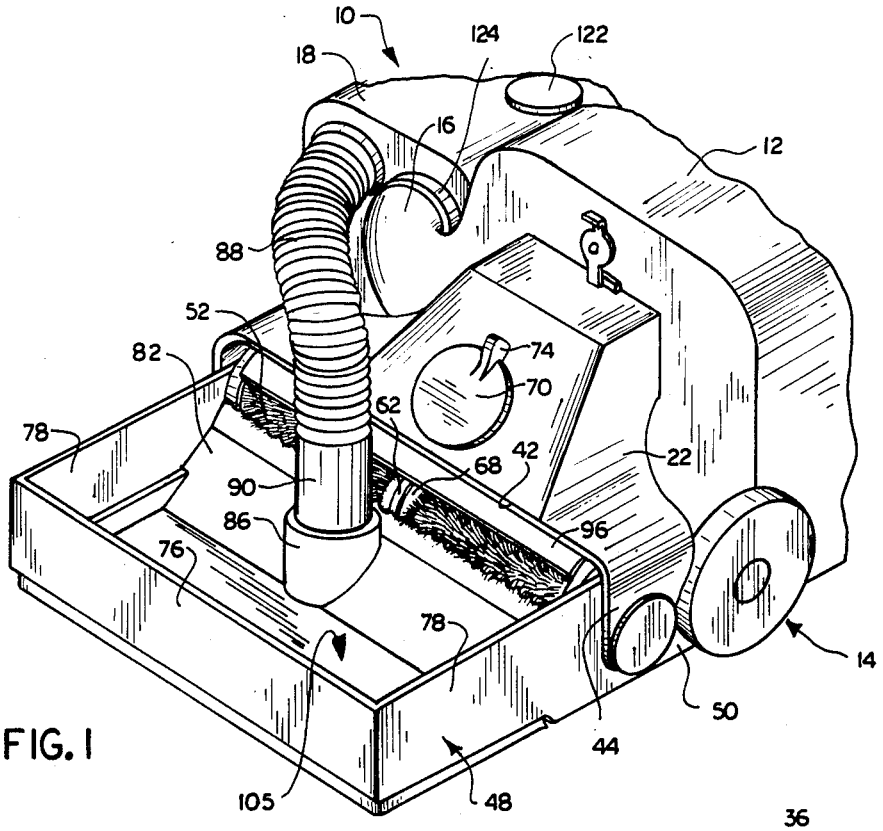
FIG. 1 is a fragmentary perspective view of a vacuum cleaner suction housing having an attachment according to this invention mounted thereon.
Figure 2:
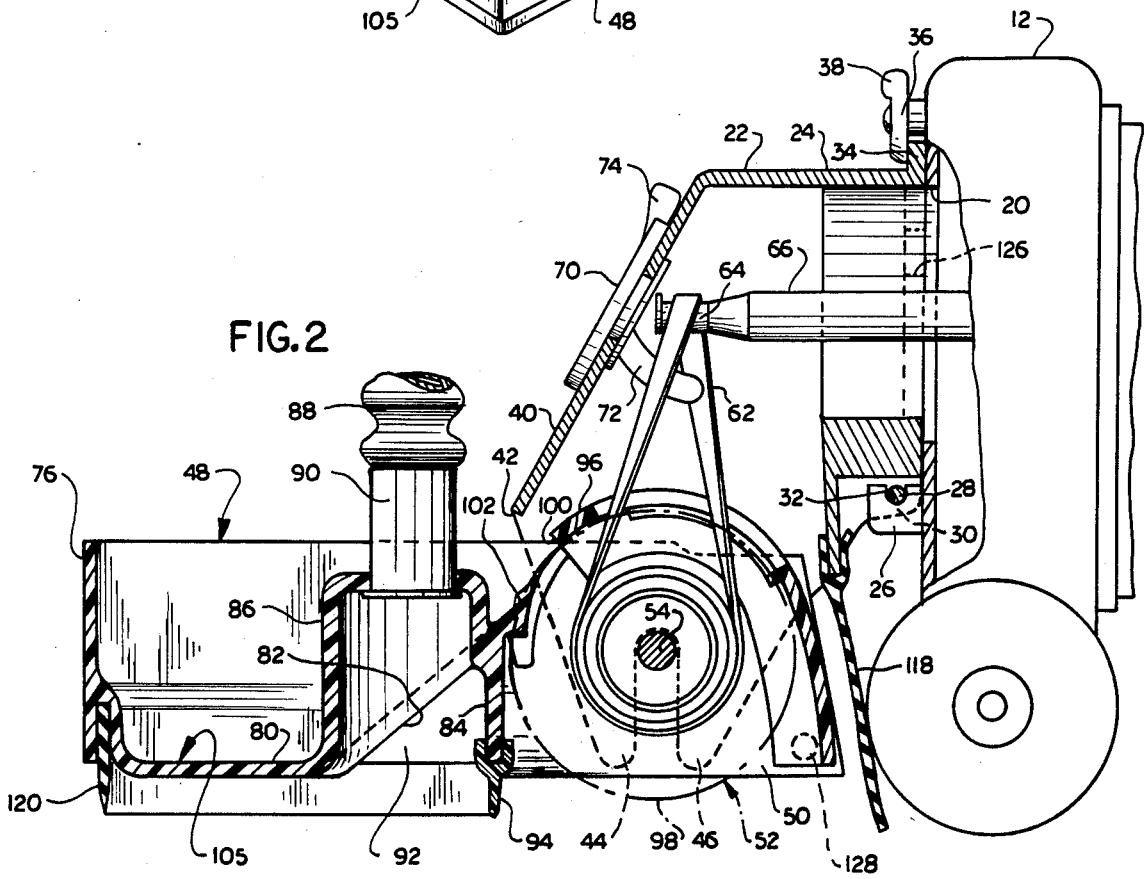
FIG. 2 is an elevational view, partly in section, of the attachment shown in FIG. 1.

Referring now to the drawings and particularly to FIGS. 1 and 2, the invention is shown in combination with a vacuum cleaner 10 of conventional construction. The vacuum cleaner 10 includes a fan casing 12 carried by a wheeled undercarriage 14. The fan casing 12 is provided with a tangential outlet 16 which is normally connected to a suitable dust collector such as a dust box and filter bag assembly, but which, according to the present invention, is attached to a suds generator 18. The fan casing 12 has a centrally disposed inlet opening 20 in its front face and the opening 20 is normally surrounded by the tubular conduit of a vacuum nozzle which is normally provided on such a casing. According to the present invention, however, the opening 20 is engaged by a brush housing 22. The brush housing 22 includes a tubular rearwardly extending attaching portion 24 that is adapted to surround the inlet opening 20.

The front face of the fan casing 12 is provided with lugs 26 which support a horizontal rod 28 a short distance below the inlet opening 20 of the fan casing. The attaching portion 24 of the housing has laterally spaced, downwardly extending lugs 30 provided on their undersides with recesses 32, which cooperate with the rod 28. On the upper edge of the attaching portion 24, an upwardly protecting flange 34 is provided. The flange 24 is engaged by a locking cam 36 which is rotatably mounted on the fan casing and is provided with a projecting handle 38 so that it may be quickly and easily turned to or from a locking position.

The housing 22 further includes a forwardly and downwardly directed brush housing portion 40. The housing portion 40 is provided with a horizontal front opening 42 and downwardly extending ends 44. Each end 44 is provided with a vertical notch 46 and the ends 44 engage the outer sides of a removable suds confining and distributing portion 48. The portion 48 is provided with a pair of rearwardly extending sides 50 which support a brush roll 52 for rotation about the horizontal axis of the brush roll. The brush roll 52 includes an axially extending mounting rod 54 which is mounted in suitable bearings 56 and extends through the sides 50 and is received in each notch 46. Protective and locating disks 58 are located on the ends of the rod 54.

The brush roll 52 is provided with a plurality of bristle tufts 60 and is driven in a counterclockwise direction, as viewed in FIG. 2 by a belt 62, which is twisted to provide an upper loop which engages a pully portion 64 of a shaft 66. The shaft 66 is driven by a fan motor (not shown) within the casing 12. The belt 62 has a lower loop which is wrapped around a central pulley portion 68 of the brush roll 62.

A belt lifting member 70 is positioned on the front wall of the housing 22 and has a finger 72 which extends into the interior of the housing 22 to function as a belt lifter to remove the belt 62 from or apply the belt to the shaft 66. When the member 70 is rotated by gripping a handle 74, the finger 72 engages a portion of the belt 62 and further rotation of the member 70 lifts the belt from its shaft 66 to disengage the belt therefrom.

The suds distributing and collecting portion 48 includes a front wall 76, side walls 78, a bottom wall 80, a wall 82 which is inclined upwardly from the bottom wall 80, and a wall 84 which extends downwardly from the wall 82. The wall 82 has central tubular opening 86 which is connected to a flexible conduit 88 by means of a fitting 90.

In a manner which will hereinafter become apparent, cleaning suds are delivered through the conduit 88 and into a suds distributing chamber 92, which chamber is defined by the inclined wall 82, the wall 84, and the side walls 78. The suds are confined in the chamber 92 and, upon forward movement of the vacuum cleaner are permitted to flow around a centrally located baffle 94 and under the wall 84 in even layers toward the brush roll 52. The suds are, therefore, directed toward the tufts 60 on the brush roll and are guided away from the portion 68 by the baffle 94 to prevent the suds from contacting the portion 68 and its driving belt 62 so that slippage of the belt is minimized. The suds are worked into the rug by the brush roll 52 and the suds are picked up by the brush roll and carried upwardly and forwardly with the roll. Suds and nap from the rug which would otherwise be thrown from the brush roll toward the suction inlet 20 and the pulley 64 are confined by a shield 96 which closely conforms to an envelope 98 traced by the path of travel of the tufts 60. The spent suds together with the lint and nap from the rug are forced outwardly along the brush bristles but are confined by the shield 96 until the bristles reach an end lip 100 of the shield 96 at a location on the envelope 98 which is tangentially directed toward a doctor blade 102 for the spent suds, rug nap and lint. The doctor blade 102 is an extension of the inclined wall 82 and suds and lint previously confined by the cover 96 are thrown toward the doctor blade 102 to travel down the inclined wall 82 and into a spent suds collecting trough 104 formed by the walls 78, 82, 76 and 80.

Figure 6:
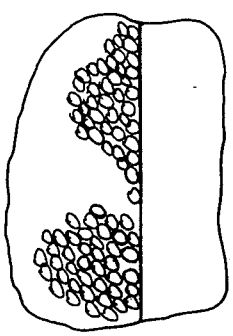
FIG. 6 (PRIOR ART)
FIG. 6 is a semi-schematic representation of the whiping action by the prior art doctor blade on the brush bristles.
Figure 7:
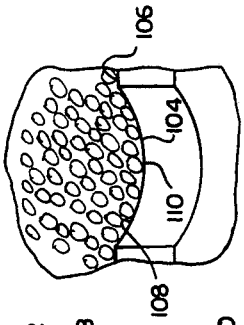
FIG. 7 is a semi-schematic representation of the whiping action by the doctor blade according to this invention on the brush bristles.
Figure 8:
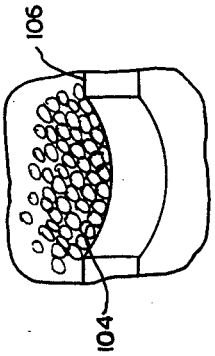
FIG. 8 is a semi-schematic representation similar to FIG. 7 but showing the brush bristles after progressing along the intrados of the arch and toward the point of maximum use thereof.
Figure 3:
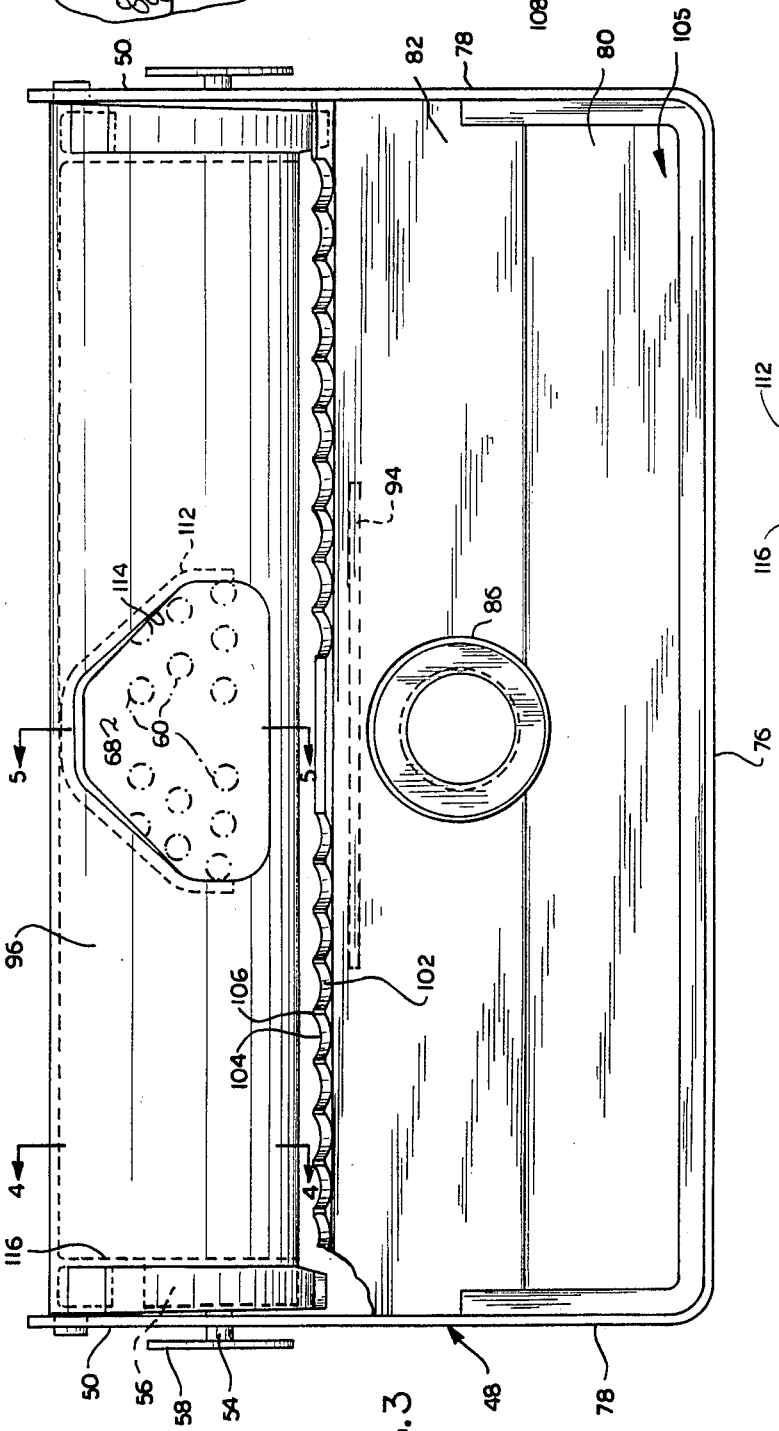
FIG. 3 is a plan view of a portion of the rug cleaning attachment.
Figure 5:
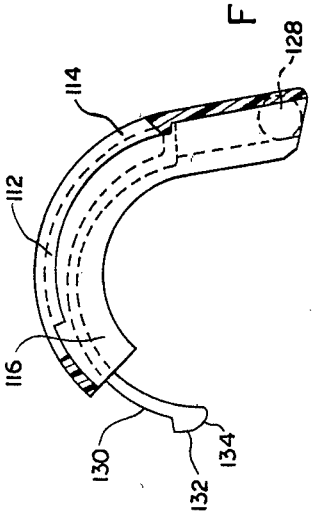
FIG. 5 is a cross-sectional view, the plane of the section being indicated by the line 5—5 in FIG. 3.

Suds and lint which tend to remain in the brush bristles are scraped from the bristles by the doctor blade 102 which projects into the envelope 98 defined by the brush bristles. The doctor blade 102 has a scalloped edge provided with a multiplicity of arches 104 which form cusps 106. A number advantages obtain in providing a doctor blade having a scalloped edge as compared to prior art doctor blades having a straight edged blade. In the case of a straight edged blade bristle wear may necessitate an adjustable blade to compensate for end wear of the bristles. A scalloped blade on the other hand provides a wider range of bristle contact as the bristles wear at their edges. Furthermore, and as may be seen in FIGS. 6 through 8 a scalloped doctor blade provides a more effective stripping action on the bristle tufts. In FIG. 6 a prior art doctoring blade having a straight edge is wiped by bristles and the tufts tend to be spread apart by the blade. In FIGS. 7 and 8, the scalloped edges tend to force the bristles together as they are drawn along the intrados 108 of each arch 104 toward the point 110 of maximum rise thereof to squeeze spent suds from the brush, much like the action resulting when one squeezes or combs excess paint from a paint brush. Furthermore, the cusps 106 comb filaments from the brush by their cuspidal projection into the envelope defined by the bristles.

In addition to the blockage provided by the baffle 94 the suds are further blocked from the belt 62 by a curbing lip 112 which is provided about a belt receiving opening 114 in the cover 96. Moreover, end fenders 116 are provided to protect the bearings 56 from the suds. Further suds confinement is provided by a flap 118 and by a flap 120 which extends about the suds depositing portion of the attachment to ensure that excess suds are not distributed on the rug when the cleaner is pulled backwardly.

The suds generating container 18 is more fully described in U.S. Pat. No. 3,370,315 and includes a filling cap 122 which may be removed for pouring a suitable liquid rug cleaner into the container 18. The exhaust outlet 16 of the housing 12 is connected to an opening 124 in the container 18.

The exhaust from the vacuum cleaner 10 places a moderate positive pressure on the surface of the cleaning liquid in the container 18 and forces some of the liquid through a discharge nozzle within the container and that liquid together with air forced from the vacuum cleaner generates suds which are expelled through the hose 88 to the suds generating chamber 92.

To ensure that foam will not be sucked into the fan casing, the housing 22 is provided with openings 126 so that air will be drawn through those openings rather than through the suds at the bottom of the housing 22.

Figure 4:
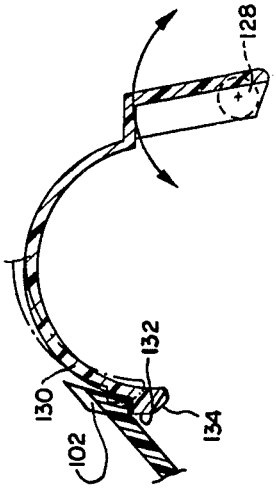
FIG. 4 is a cross sectional view, the plane of the section being indicated by the line 4—4 in FIG. 3.

From time to time spent suds may be removed from the receptacle 104 and the shield 96 may be cleaned to remove accumulated dirt and fibers. To clean the shield 96 the housing 22 is removed from the fan casing 12 by engaging the belt lifting finger to lift the belt 62 from the pulley 64 and then releasing the casing 22 from the fan casing 12. The belt 62 may then be released from the finger 72 so that the portion 48 may be removed from the housing 22. After the portion 48 is removed the shield 96 may be pivoted about a hinge 128 to release end fingers 130 from beneath the doctor blade 102. As may be seen in FIG. 4 slight inward pressure may be required to release a detent 132 from the lower surface of the doctor blade 102. After cleaning and if necessary manually removing lint and dirt from the brush the shield 96 is reattached by pivoting the cover to its doctor blade engaging position. A beveled surface 134 on the detent 132 will snap the shield in place.

Although the preferred embodiment of this invention has been shown and described, it should be understood that various modifications and rearrangements of the parts may be resorted to without departing from the scope of the invention as disclosed and claimed herein.

What is claimed is:

1. A rug cleaning device comprising: a power driven brush roll mounted for rotation in a forward-downward and rearward-upward direction around a horizontal axis, said brush roll comprising a cylinder having a multiplicity of radially extending bristle tufts which upon rotation define a cylindrical envelope, a suds confining and distributing chamber mounted ahead of said brush, said chamber including means for leveling and spreading suds confined therein so that an even layer of suds is laid on the rug ahead of the brush, means for generating suds and for delivering the generated suds to the suds confining and distributing chamber, a receptacle for dirty suds mounted ahead of said brush, doctoring means between said brush and said receptacle for removing from the brush the suds that it has picked up, said doctoring means comprising a blade projecting into and invading the cylindrical envelope defined by the path of travel of said tufts, said blade having a scalloped edge providing a multiplicity of cusp forming arches engaged by said tufts so that the adjacent bristles of each tuft are drawn together as they are forced along the intrados of each arch toward the point of maximum rise thereof to squeeze spent suds from the brush and so that the cusps comb filaments from said brush, whereby as said rug cleaning device is advanced, suds that had been laid down by said suds confining and distributing chamber are used by the brush to clean the rug, and each increment of suds that is picked up by the brush in the course of such cleaning is carried partially around the brush and removed by the doctoring means prior to completion of a single turn of the brush.

2. A rug cleaning device according to claim 1, wherein said brush is driven by a belt wrapped around a central portion of said cylinder, wherein said means for leveling and spreading suds comprises a vertical wall separating the brush roll from the suds confining and distributing chamber, and including baffle means projecting from a central portion of said vertical wall to direct suds away from the central portion of said cylinder.

3. A rug cleaning device according to claim 1, wherein a major portion of the cylindrical envelope defined by the bristle tufts between the rug contacting area of the brush and the doctor blade is confined by a shield to prevent excessive centrifugal spraying of suds from the brush in that area.

4. A rug cleaning attachment for a vacuum cleaner, comprising: a mounting nozzle adapted to be attached to the suction inlet opening of a vacuum cleaner of the type having a fan housing and a belt drive shaft projecting through the suction opening, said mounting nozzle having a wide mouth opening with shaft mounting slots at its ends, a brush roll mounting tray for confining and distributing suds and for collecting spent suds, said tray including a front wall and laterally spaced side walls, a brush roll mounted for rotation between rearward projecting extensions of said sidewalls in a forward-downward and rearward-upward direction around a horizontal axis, said brush roll comprising a cylinder having a multiplicity of radially extending bristle tufts which upon rotation define a cylindrical envelope, a bottom wall extending along said front wall and between said side walls, an inclined wall extending upwardly from said bottom wall and between said sidewalls and terminating adjacent said brush roll to define a doctor blade for said brush roll, said bottom wall, said front wall, said side walls and said inclined wall, defining a spent suds collecting trough, a vertical wall extending downwardly from said inclined wall adjacent said doctor blade to define a suds confining and distributing chamber ahead of said brush roll, said vertical wall comprising means for leveling and spreading suds confined therein, said doctor blade comprising a blade projecting into and invading the envelope defined by the path of travel of said tufts, said blade having a scalloped edge providing a multiplicity of cusp forming arches engaged by said tufts, so that the adjacent bristles of each tuft are drawn together as they are forced along the intrados of each arch toward the point of maximum rise thereof to squeeze spent suds from the brush, and so that the cusps comb filaments from said brush, whereby as said rug cleaning device is advanced suds that have been laid down by the suds confining and distributing chamber are used by the brush to clean the rug, and each increment of suds that is picked up by the brush in the course of such cleaning is carried partly around the brush and removed by the doctor blade prior to completion of a single turn of the brush.

5. A rug cleaning device according to claim 4, wherein said brush is driven by a belt wrapped around a central portion of said cylinder, wherein said means for leveling and spreading suds comprises a vertical wall separating the brush roll from the suds confining and distributing chamber, and including baffle means projecting from a central portion of said vertical wall to direct suds away from the central portion of said cylinder.

6. A rug cleaning device according to claim 4, wherein a major portion of the cylindrical envelope defined by the bristle tufts between the rug contacting area of the brush and the doctor blade is confined by a shield to prevent excessive centrifugal spraying of suds from the brush in that area.

* * * * *